US007568270B2

(12) United States Patent
Cossutti

(10) Patent No.: US 7,568,270 B2
(45) Date of Patent: Aug. 4, 2009

(54) METHOD OF MANUFACTURING A FLUIDTIGHT SLIDE FASTENER

(75) Inventor: Livio Cossutti, Mendrisio (CH)

(73) Assignee: RIRI S.A. (CH)

( * ) Notice: Subject to any disclaimer, the term of this patent is extended or adjusted under 35 U.S.C. 154(b) by 71 days.

(21) Appl. No.: 11/942,296

(22) Filed: Nov. 19, 2007

(65) Prior Publication Data

US 2008/0115341 A1 May 22, 2008

Related U.S. Application Data

(62) Division of application No. 11/278,500, filed on Apr. 3, 2006, now Pat. No. 7,392,572.

(51) Int. Cl.
*A44B 19/32* (2006.01)
*B29D 5/00* (2006.01)

(52) U.S. Cl. ..... 29/408; 29/410; 29/458; 29/460; 29/766; 24/389

(58) Field of Classification Search ..... 29/408, 29/409, 410, 458, 460, 527.2, 766, 767, 768, 29/769; 24/389, 433
See application file for complete search history.

(56) References Cited

U.S. PATENT DOCUMENTS

| | | | | |
|---|---|---|---|---|
| 3,663,996 | A | 5/1972 | Heimberger et al. | |
| 4,001,922 | A | 1/1977 | Ward, Jr. | |
| 4,223,425 | A | 9/1980 | Akashi | |
| 4,233,099 | A | 11/1980 | McGuire | |
| 4,651,389 | A | 3/1987 | Yoshida et al. | |
| 4,839,956 | A | 6/1989 | Osaki | |
| 4,870,724 | A | 10/1989 | Fujisaki et al. | |
| 6,070,306 | A | 6/2000 | Wang | |
| 6,105,214 | A * | 8/2000 | Press | 24/389 |
| 2003/0115725 | A1 | 6/2003 | Matsumoto et al. | |
| 2004/0007309 | A1 | 1/2004 | Owen et al. | |
| 2005/0235465 | A1 * | 10/2005 | Butz | 24/389 |

FOREIGN PATENT DOCUMENTS

| | | |
|---|---|---|
| EP | 0 345 799 A1 | 12/1989 |
| EP | 0 522 366 A1 | 1/1993 |
| GB | 631265 | 10/1949 |
| GB | 650599 | 2/1951 |
| WO | WO 02/063988 A1 | 8/2002 |

* cited by examiner

*Primary Examiner*—Jermie E Cozart
(74) *Attorney, Agent, or Firm*—Akerman Senterfitt

(57) ABSTRACT

A fluidtight slide fastener comprising a pair of tapes both delimited by two opposite long edges and by two opposite short edges, each tape comprising a textile material strip coated with a fluid barrier material layer at least at the opposite faces thereof, the strip remaining uncoated at least one of the short edges of each tape, each tape being equipped with a set of aligned teeth on at least a portion of one of the long sides thereof, the aligned teeth of the sets facing each other and being associated with opposite opening and closing stops, and a slider slidable between the closing stop and the opening stop for engaging in a fluidtight way or disengaging said aligned teeth respectively, wherein the fastener further comprises a coating formed on each tape at the at least one of the uncoated short edges for covering the textile material strip in a fluidtight way at the at least one of the uncoated short edges.

4 Claims, 5 Drawing Sheets

METHOD OF MANUFACTURING A FLUIDTIGHT SLIDE FASTENER

CROSS-REFERENCE TO RELATED APPLICATIONS

This application is a divisional of U.S. patent application Ser. No. 11/278,500 filed Apr. 3, 2006, now U.S. Pat. No. 7,392,572 B2 the entirety of which is incorporated herein by reference.

FIELD OF APPLICATION

The present invention, in its most general aspect, refers to a slide fastener.

In particular, the invention refers to a fluidtight slide fastener, i.e. a slide fastener that is impermeable to fluids.

In the following description, the term "fluidtight" means a sealing that prevents the passage of liquids, in particular water, and/or gases, for example air, even if put under pressure within predetermined high limits, for example till about 2 bar of pressure difference between the interior and exterior sides of the slide fastener.

More in particular, the present invention refers to fluidtight slide fastener of the type comprising a pair of tapes both delimited by two opposite long edges and by two opposite short edges, each tape comprising a textile material strip coated with a fluid barrier material at least in correspondence with the opposite faces thereof, each tape being equipped with a set of aligned teeth on at least a portion of one of said long edges thereof, the aligned teeth of said sets facing each other and being associated with opposite opening and closing stops, and a slider slidable between said closing stop and said opening stop for engaging in a fluidtight way or disengaging said aligned teeth respectively.

In the following description, the term "opening stop" means the stop that is reached by the slider at the end of its run disengaging the aligned teeth of the tapes while the term "closing stop" means the stop that is reached by the slider at the end of its run engaging the aligned teeth of the tapes. The opening stop and the closing stop are also known in this technical field as "bottom stop" and "top stop" respectively.

PRIOR ART

It is well-known in the art that slide fasteners comprise a pair of tapes of a textile material both delimited by two opposite long edges and by two opposite short edges, each tape being equipped with a set of aligned teeth on at least a portion of one of said long edges thereof, the aligned teeth of said sets facing each other and being associated with opposite opening and closing stops, and a slider slidable between said closing stop and said opening stop for engaging or disengaging said aligned teeth respectively.

It is also known that in some appliances, such as for example diving or sailing suits, slide fasteners are required to be fluidtight to prevent passage of fluids, in particular water, between the interior and exterior sides of the slide fasteners.

To this purpose, the manufacturing process of said slide fasteners provides that the textile material of the tapes be coated with a fluid-barrier material before equipping the tapes with the respective set of aligned teeth. In particular, according to this manufacturing process, the coating with the fluid-barrier material is performed on very long textile material strips coming from a textile material spool, at least at the opposite faces of the strips. The strips so coated are then equipped with a plurality of sets of aligned teeth along their longitudinal edge in a per se conventional manner (for example through die-casting or injection molding) and cut transversally (i.e. in the direction of their width) among consecutive sets of aligned teeth to obtain tapes of the desired dimensions each of them being equipped with a set of aligned teeth. The slide fasteners are then obtained each from a pair of such tapes through a succession of further conventional steps among which the steps of equipping each pair of tapes with opening and closing stops and a slider running between such stops. However, due to the cutting step, the textile material of each tape remains uncoated at least one of the short edges thereof.

It should be noticed that the slide fasteners are normally joined to the material of the suit/garment in a fluidtight way at the long edges of the tapes free of aligned teeth and often also at one of their short edges. In addition, a fluidtight sealing is also obtained at the long edges of the tapes equipped with the set of aligned teeth when such long sides of the tapes are joined to each other by the reciprocal engagement of the two sets of aligned teeth.

Therefore, after having joined the slide fastener to a garment or suit, the textile material of each tape can still remain uncoated at least one of the short edges thereof. As a result, the fluids, in particular water, may seep in the textile material strip of the tapes, causing in a long run an undesired swelling of the tape itself or even separation (delamination) of the coating of the fluid-barrier material from the textile material strip, which finally leads to the loss of the required fluidtight features of the slide fastener. This problem may result as a consequence of subjecting the slide fastener to fluids (for example water) both during the normal use of the garment incorporating it and during (intensive) washing cycles of said garment.

In order to prevent that the fluids seep in the textile material strip of the tapes of slide fasteners, the prior art suggests to fold the uncoated short edges of the tapes with a 180° angle and join the folded portion to one of the coated faces of each tape, generally through a thermal or chemical welding.

Although advantageous from various points of view, a fluidtight slide fastener of the type schematically described above has recognized drawbacks, the first of which is linked to the fact that the process for manufacturing the slide fastener is complicated due to the provision of such folding and welding steps of the tape ends.

Another drawback of the fluidtight slide fastener structured in the way schematically described above, is that the folded portions thicken the tapes at the folded short edges, so that it is difficult to reliably join the tapes to the material of the suit/garment where the slide fastener has to be applied.

Moreover, in some appliances, such as diving suit for deep sea use, the above process cannot be applied since the tape are obtained in a so thick and rigid structure that they cannot be suitably folded.

SUMMARY OF THE INVENTION

The technical problem underlying the present invention is that of devising and providing a fluidtight slide fastener of the type considered, which is reliable in the long run with regard to its fluidtight requirement and which is at the same time easier and cheaper to be manufactured, so as to overcome the quoted drawbacks with reference to the prior art.

This problem is solved, according to the present invention, by a fluidtight slide fastener comprising a pair of tapes both delimited by two opposite long edges and by two opposite short edges, each tape comprising a textile material strip coated with a fluid barrier material layer at least at the opposite faces thereof, the strip remaining uncoated at least one of said short edges of each tape, each tape being equipped with a set of aligned teeth on at least a portion of one of said long sides thereof, the aligned teeth of said sets facing each other and being associated with opposite opening and closing stops, and a slider slidable between said closing stop and said opening stop for engaging in a fluidtight way or disengaging said aligned teeth respectively, wherein the fastener further comprises a coating formed on each tape at said at least one of said uncoated short edges for covering the textile material strip in a fluidtight way at said at least one of said uncoated short edges.

According to an embodiment of the present invention, said coating on each tape is at least a seal of fluid barrier material obtained by welding or sealing together at least one of said uncoated short edges of said fluid barrier material layers on the opposite faces of the respective tape and optionally a filler of additional fluid-barrier material.

It has been surprisingly found that a slide fastener as above shows good fluidtight requirements in the long run while at the same time it can be obtained in a simple manner and at reduced costs as the welding or sealing step can be easily carried out and integrated in conventional manufacturing processes of fluidtight slide fasteners. In particular, as it will be clearly explained later on, the sealing or welding step can be implemented together with the cutting step of strips coated with a fluid-barrier material from which the tapes are obtained. According to another embodiment of the present invention, said coating is at least a cap applied on each tape at said at least one of said uncoated short edges for covering the textile material strip in a fluidtight way at said at least one of said uncoated short edges.

In this way, it is achieved the additional advantage of strengthening the slide fastener at its short edge(s) to which the cap is applied so rendering the slide fastener in particular more resistant to wear.

The present invention further relates to a process for manufacturing a slide fastener as described above. According to a preferred embodiment of the invention, the process comprises the steps of:

providing a plurality of strips of a textile material covered with a fluid-barrier material layer at least on their opposite faces, equipping each coated strip with a plurality of sets of aligned teeth along a longitudinal edge thereof, heat cutting each coated strip transversally among consecutive sets of aligned teeth to obtain a plurality of tapes of the desired dimensions wherein each tape is equipped with a set of aligned teeth and wherein the textile material is sealed in a fluidtight way at the short cutting edges of the tapes by a portion of said fluid-barrier material of the layers on the opposite faces of said strip, coupling said plurality of tapes in pairs and equipping each pair of tapes with a closing stop, an opening stop and a slider slidable between said closing and opening stops.

In this embodiment, the heat cutting step can be advantageously carried out through a heated blade or laser cutting. In particular, the strips are pressed by the blade on its cutting areas while at the same time the heat allows a portion of said fluid-barrier material on the opposite faces of said strips to melt and seal at the cutting edges of the resulting tapes so covering the textile material in a fluidtight way at the cutting edges.

According to another preferred embodiment of the present invention, the process comprises the steps of:

providing a plurality of strips of a textile material covered with a fluid-barrier material layer at least on their opposite faces, equipping each coated strip with a plurality of sets of aligned teeth along a longitudinal edge thereof, cutting each coated strip transversally among consecutive sets of aligned teeth to obtain a plurality of tapes of the desired dimensions wherein each tape is equipped with a set of aligned teeth and is uncoated with said fluid-barrier material at least one of the short edges thereof, coupling said plurality of tapes in pairs and equipping each pair of tapes with a closing stop, an opening stop and a slider slidable between said closing and opening stops, wherein the process further comprises the step of providing a coating on each tape at said at least one of said uncoated short edges for covering the textile material strip in a fluidtight way at said at least one of said uncoated short edges.

Preferably, the coating step can be advantageously carried out by heat pressing each tape at said at least one of said uncoated short edges to allow a portion of said fluid-barrier material on the opposite faces thereof to melt and seal at the said short edge(s) so covering the textile material in a fluidtight way at said short edge(s).

As an alternative, the coating step can be advantageously carried out by heat pressing each tape at said at least one of said uncoated short edges while filling said uncoated edge(s) with additional fluid-barrier material so as to form a seal covering the textile material in a fluidtight way at said short edge(s), the seal consisting of said additional fluid-barrier material and a portion of said fluid-barrier material on the opposite faces of the respective tape.

As a further alternative, the coating step can be advantageously carried out by applying at least a cap in a fluidtight way on each tape at said at least one of said uncoated short edges for covering the textile material strip in a fluidtight way at said at least one of said uncoated short edges.

Further characteristics and the advantages of the fluidtight slide fastener according to the present invention shall become clearer from the following description of preferred embodiments thereof, given for indicating and not limiting purposes, with reference to the attached figures.

DETAILED DESCRIPTION OF A PREFERRED EMBODIMENT

Figure 1:
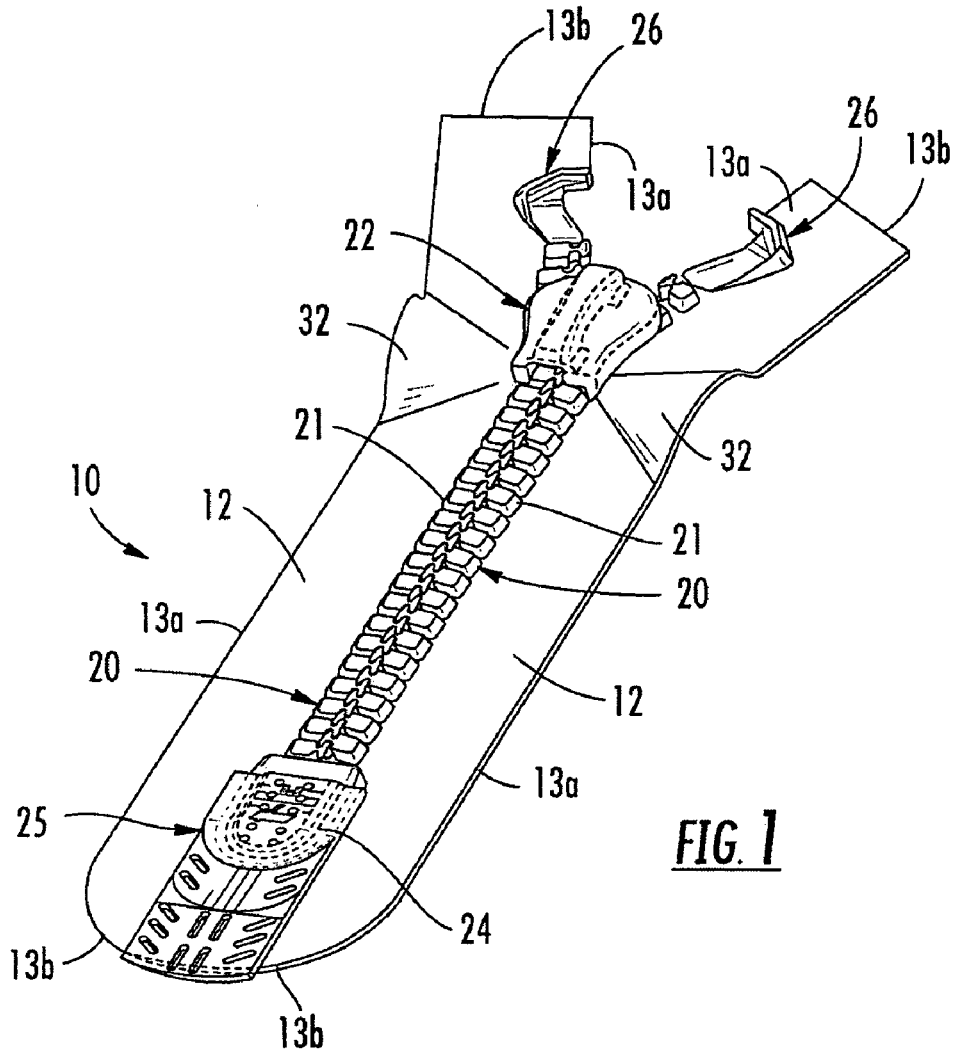
FIG. 1 schematically represents a perspective view of a fluidtight slide fastener according to an embodiment of the present invention.
Figure 2:
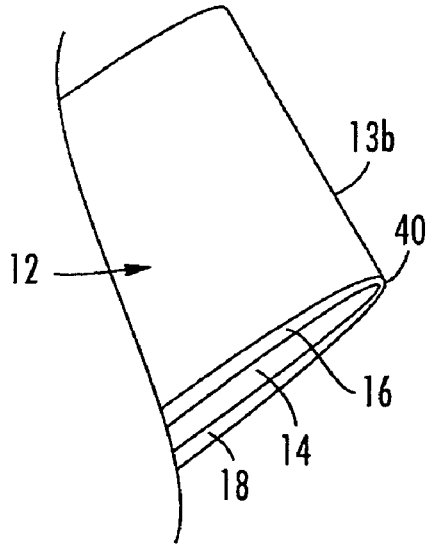
FIG. 2 schematically represents an enlarged perspective view of a detail of the fastener of FIG. 1.

With reference to FIGS. 1 and 2, a fluidtight slide fastener is shown, in accordance with the present invention and globally indicated with 10.

The slide fastener 10 comprises a pair of tapes 12, substantially parallel to each other, the tapes 12 being delimited by respective inner and outer long edges 13*a*, the inner long edges 13*a* facing to each other, and opposite upper and lower short edges 13*b*.

Each tape 12 is equipped with a set 20 of aligned teeth 21 on a central portion of the inner long edge 13*a* thereof, in a conventional manner, for example through die-casting or injection molding processes.

In particular, the aligned teeth 21 of said sets 20 face each other and are associated with opposite opening stop 24 and closing stop 26. A slider 22 is slidable between the opening stop 24 and the closing stop 26 for engaging in a fluidtight way or disengaging of aligned teeth 21 of said sets 20 respectively as it will explained better later on in the present description. In particular, the slider 22 stops its opening stroke at the opening stop 24, so disengaging the aligned teeth 21 of said sets 20 whereas the slider 22 stops its closing stroke at the closing stop 26 so engaging in a fluidtight way the aligned teeth 21 of said sets 20.

In the FIGS. 1 and 2, the opening stop 24 is in form of a one single piece applied on both the tapes 12 at the lower ends of the sets 20 of aligned teeth 21, whereas the closing stop 26 comprises two half-portions, each half-portion being applied on a respective tape 12 at the upper end of the respective set 20 of aligned teeth 21.

The application of the opening stop 24 and the closing stop 26 to the tapes 12 can be carried out in a per se conventional manner for example through die casting or injection molding.

Figure 4:
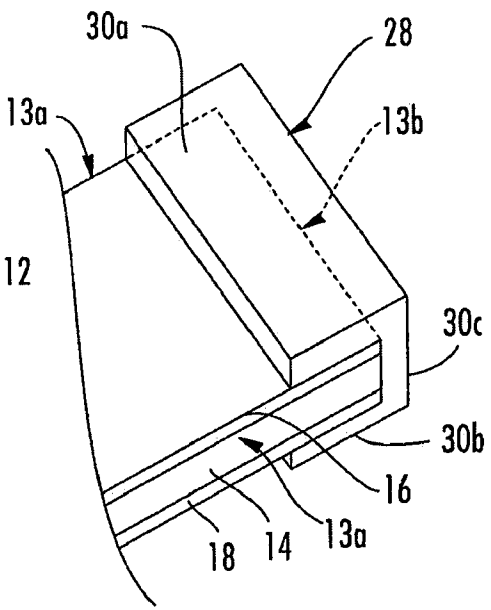
FIG. 4 schematically represents an enlarged perspective view of a detail of the fastener of FIG. 3.
Figure 3:
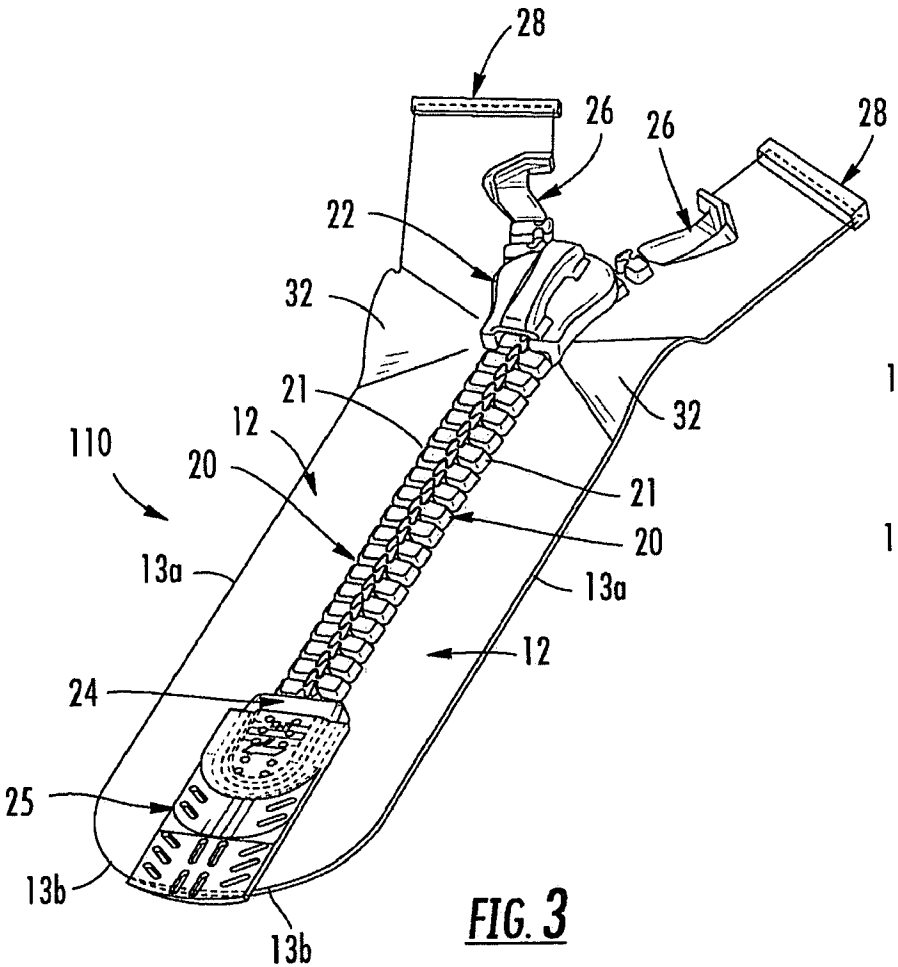
FIG. 3 schematically represents a perspective view of a fluidtight slide fastener according to another embodiment of the present invention.
Figure 5:
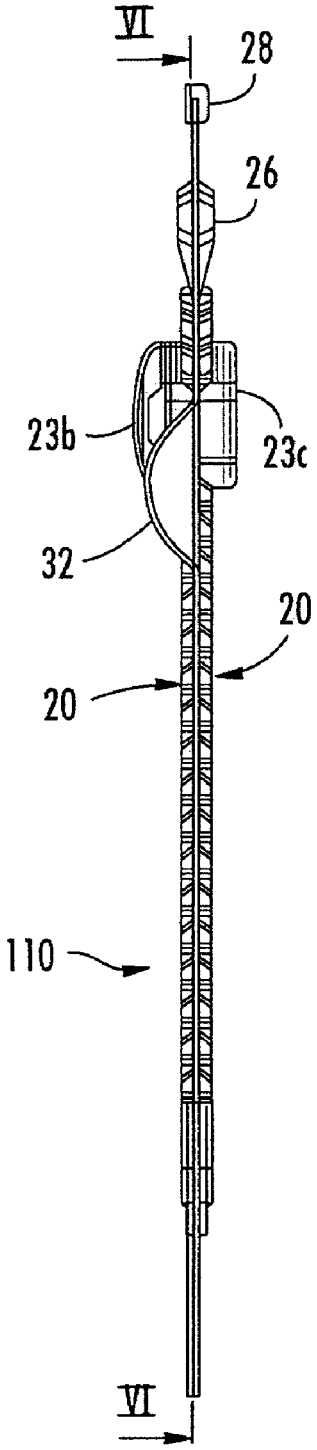
FIG. 5 schematically represents a view in side elevation of the fastener of FIG. 3.
Figure 6:
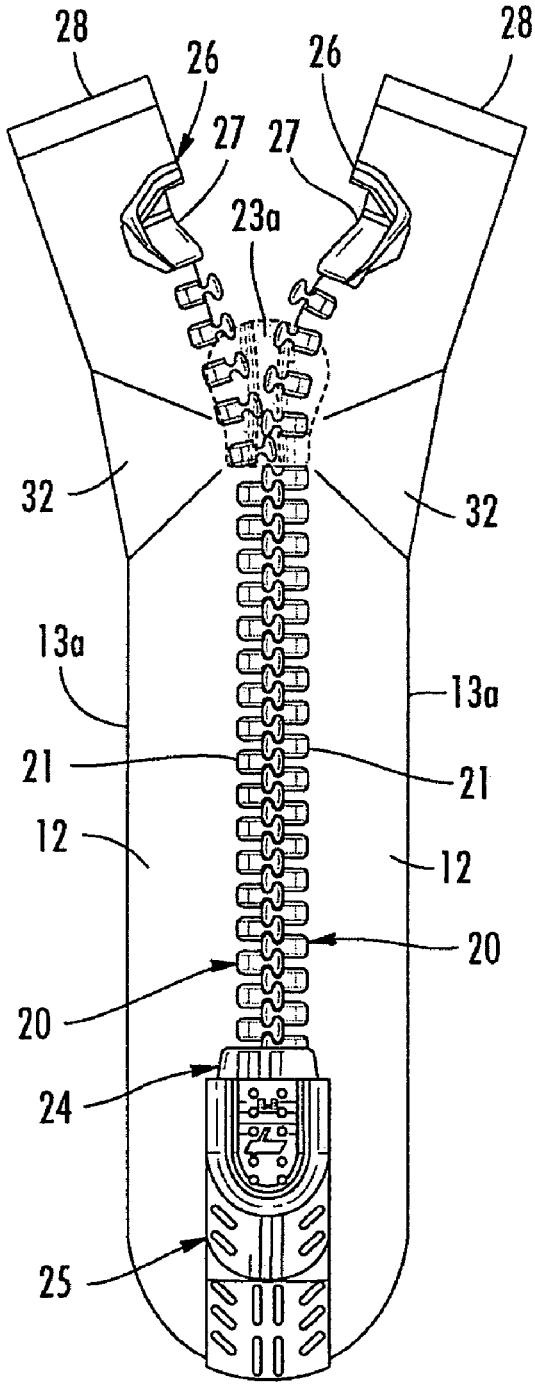
FIG. 6 schematically represents a enlarged section view of part of the fastener of FIG. 5, taken according to the traced plane VI-VI of FIG. 5 itself.

Furthermore, the tapes 12 are joined in a fluidtight way along at a portion 25 of the respective inner long edges from the sets 20 of aligned teeth 21 and comprising the opening stop 24. In particular, with reference to FIGS. 1 and 4, on the external side of the slide fastener 10 (the external side being in use the side that is exposed to fluids) the portion 25 extends from the lower ends of said sets 20 of aligned teeth 21 up to the lower short edges 13*b* of the tapes.

As shown in FIG. 2, each tape 12 comprises a textile material strip 14 coated with a fluid barrier material. In accordance with the present invention, the coating of the strips 14 is carried out by fully covering with a fluid-barrier material a strip of textile material forming the tapes 12 and equipped with a plurality of sets 20 of aligned teeth 21 at one of its longitudinal edges and then transversally heat cutting said coated strip forming the tapes 12. As a result, in each tape 12, the strip 14 is coated at the long edges 13*a*, at the two opposing faces by respective fluid barrier layers, 16 and 18 and at least one of its short edges 13*b* (i.e. the short edges formed by the cutting) by a seal 40 resulting from the sealing or welding of the fluid barrier layers 16 and 18. In particular, as shown in FIG. 2, the fluid barrier layers 16 and 18 result substantially compacted and fused at a short edges 13*b* of the tape 12 so forming a compact seal 40 of fluid-barrier material which covers the textile material of the strip 14 in a fluidtight way at said short edge 13*b*. This result can be obtained both by heat cutting a coated strip forming the tapes 12, for example through a heated blade, and by heat pressing uncoated short edges of tapes 12 after having formed the tapes 12 by cutting in a conventional way (i.e. without heat) a strip forming said tapes 12.

In this way, during use of the slide fastener 10, the fluids, in particular water, are advantageously prevented from seeping in the textile material strips 14 through the short edges 13*b* of the tapes 12.

In the slide fastener, the textile material of the strip 14 may be any woven fabric or not woven fabric of natural or synthetic fibres such as for example polyester.

The fluid-barrier material constituting the coating of the strip 4 may be any material suitable to provide a fluidtight seal for the strip 14. A not limitative example of such a fluid barrier material includes polyurethane.

In the slide fastener 10, each tape 12 is intended to be joined in a fluidtight way to the material of a suit/garment (not shown in the figures), at the outer long edge 13*a* and the lower short edge 13*b* thereof.

This joining is generally carried out in a conventional way, for example by seaming the tapes at their inner side to a corresponding inner fabric layer of the garment and by heat welding the tapes at their outer side to the inner side of an outer fluid-barrier layer of the garment after having interposed a strip of heat-weldable material between said tapes and outer fluid-barrier layer.

With reference now to FIGS. 3-8, a second embodiment of a fluidtight slide fastener according to the present invention, globally indicated with 110, is now described.

In the slide fastener 110, elements structurally and/or functionally equivalent to those of the slide fastener 10 are indicated with the same reference numerals, and the description thereof is not repeated.

The slide fastener 110 substantially differs from the slide fastener 10 described above in that each tape 12 is obtained from an original strip forming said tapes 12 with upper short edges 13*b* being uncoated with fluid-barrier material of fluid-barrier layers 16 and 18 and that two caps 28, structurally and functionally identical, are applied in a fluidtight way to a respective tape 12 at the upper short edge 13*b* thereof, i.e. the short edge 13*b* proximate to the relative closing stop 26, to fully cover the textile material strip 14 in correspondence with the upper short edges 13*b* of the tapes 14.

In more detail, the cap 28 has a substantially "C" shape comprising two end portions 30*a* and 30*b* covering in a fluidtight way a respective end portion of the two fluid barrier layers 16 and 18, at said upper short edge 13*b*, and an intermediate portion 30*c* covering said upper short edge 13*b*.

In this way, during use of the slide fastener 10, the fluids, in particular water, are advantageously prevented from seeping in the textile material strips 14 through the upper short edges 13*b* of the tapes 14.

Preferably, each cap 28 is made of a fluid-barrier plastic material and in particular it is of the same material forming the fluid-barrier layers 16 and 18 on the opposite faces of the strip 14. Alternatively, each cap 28 is made of a fluid-barrier plastic material compatible with material forming the fluid-barrier layers 16 and 18, i.e. which is suitable to be directly welded onto said layers through chemical bonding, in the absence of any additional adhesive layer or bonding agent.

The application of the caps 28 to the tapes 14 at the short edges 13*b* can be carried out in a conventional manner, for example through plastic material injection processes or gluing.

In addition, it should be noticed that although the caps 28 are shown applied on the tapes 14 at their upper edges 13*a*, as in the FIGS. 3-8, they can be applied alternatively at the lower short edges 13*b* or at both the upper and lower short edges 13*b* as well. In particular, this latter alternative can be practiced on so-called open-ends fasteners, i.e. slide fasteners that are joined to a garment or suit only at the outer long edges 13*a* of the tapes 12 so as to cover in a fluidtight way both the upper and lower short edges 13*b*.

Figure 9:
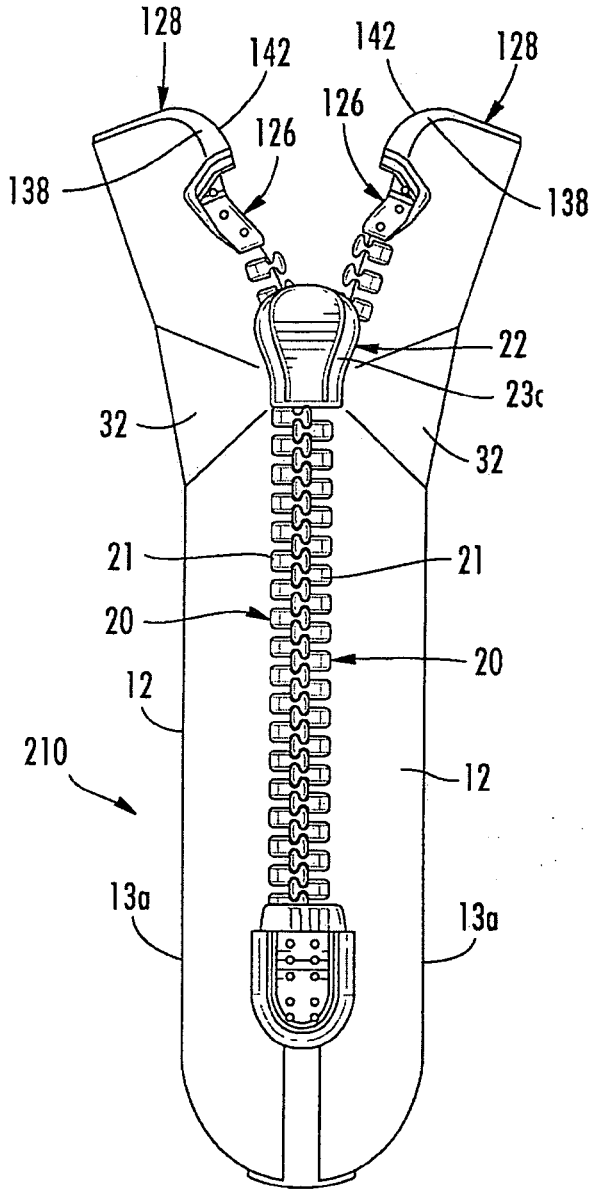
FIG. 9 schematically represents a bottom plan view of a fluidtight slide fastener according to a further embodiment of the present invention.
Figure 10:
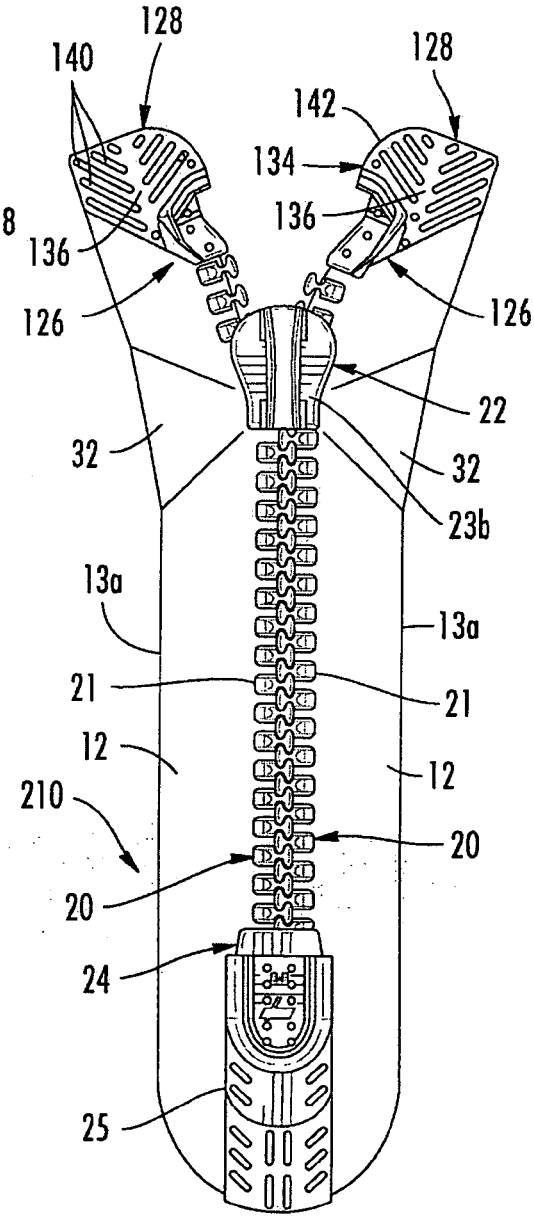
FIG. 10 schematically represents a top plan view of the fastener of FIG. 9.

With reference now to FIGS. 9 and 10 a third embodiment of a fluidtight slide fastener according to the present invention, globally indicated with 210, is now described. In the slide fastener 210, elements structurally and/or functionally equivalent to those of both the slide fastener 10 and the slide fastener 110 are indicated with the same reference numerals, and the description thereof is not repeated.

As in the slide fastener 110 described above, the slide fastener 210 has two tapes 12 formed with upper short edges 13*b* being uncoated with fluid-barrier material of fluid-barrier layers 16 and 18.

In addition, the slide fastener 210 has two caps 128, structurally and functionally identical, which are applied in a fluidtight way to a respective tape 12 at the upper short edge 13*b* thereof, i.e. the short edge 13*b* proximate to the relative closing stop 126, to fully cover the textile material strip 14 in correspondence with the upper short edges 13*b* of the tapes 14.

In particular, in this embodiment, the two caps 128 are formed integral with respective half-portions of the closing stop 126, and are connected to the tapes 12 in a conventional manner for example through die casting or injection molding. In more detail, each cap 128 comprises a external plate 136 and a internal plate 138, which cover the corresponding end portion of the two fluid barrier layers 16 and 18 of the respective tape 12 at its upper short edge 13*b* and the textile material strip 14 of the respective tape 12 at said upper short edge 13*b* Slits 140 are provided on the external plate 136, in order to make easier the association of the cap 128 with the external fluid barrier layer 16. In the example illustrated, the external plate 136 is wider than the internal plate 138, in order to make easier the positioning of the cap 128 during the manufacturing process of the slide fastener 210.

Moreover, each cap 128 also covers an end portion 142 of the inner long edge 13*a* of the respective tape 12 joining to the relative closing stop 126. Preferably, said end portion 142 of the inner long edge 13*a* has a rounded shape, in order to make the slide fastener 210 more ergonomic.

Another aspect of the present invention, which is common to all embodiments of the present invention is now described only with reference to the slide fastener 110 illustrated in FIGS. 3-8 for sake of conciseness.

According to this aspect of the invention, the slider 22 of the slide fastener 110 has an external plate 23*b* (to be associated with a puller—not illustrated—) and an internal plate 23*c* embracing together said sets 20 of aligned teeth, and a middle portion 23*a* of substantially wedge-shaped cross section, positioned between said external plate 23*b* and said internal plate 23*c*. In addition, each half-portion of said closing stop 26 has a respective substantially half wedge-shaped recess 27 at the inner long edges 13*a* of the tapes so that the half-portions of said closing stop 26 form together a housing 27*a* having dimensions at least matching the dimensions of middle portion 23*a* of the slider 22 when the slider 22 stops in its closing stroke.

As a result, when the slider 22 is closing (see FIG. 6), the two sets 20 of aligned teeth are guided by the slider 22 against the two opposed sides of the wedge, until the two sets 20 of aligned teeth mesh at the vertex of the wedge. At the same time, the tapes 14 are normally divaricated at the portions downwards the slider 22 (i.e. toward the closing stop 26) so that folds 32 are normally formed upstream the slider 22 (i.e. where the teeth 21 have been already engaged).

When the slider 22 approaches its closing stroke (see FIG. 8), the half-portions of the closing stops 26 are guided by the external plate 23*b* and the internal plate 23*c* to close each other so gradually forming the housing 27*a* in which the wedge-shaped middle portion 23*a* of the slider 22 will be housed at the time the slider 22 stops in its closing stroke.

Figure 8:
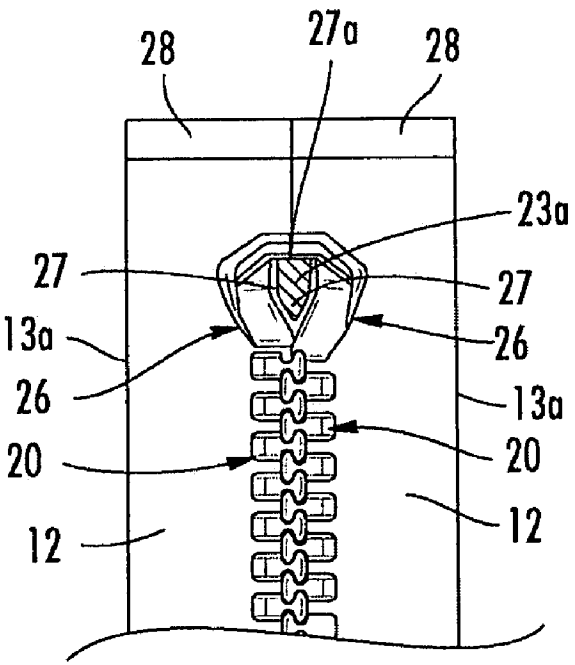
FIG. 8 schematically represents another enlarged section view of part of the fastener of FIG. 5, taken according to the traced plane VI-VI of FIG. 5 itself, wherein the slider has reached the closing stop of the fastener.
Figure 7:
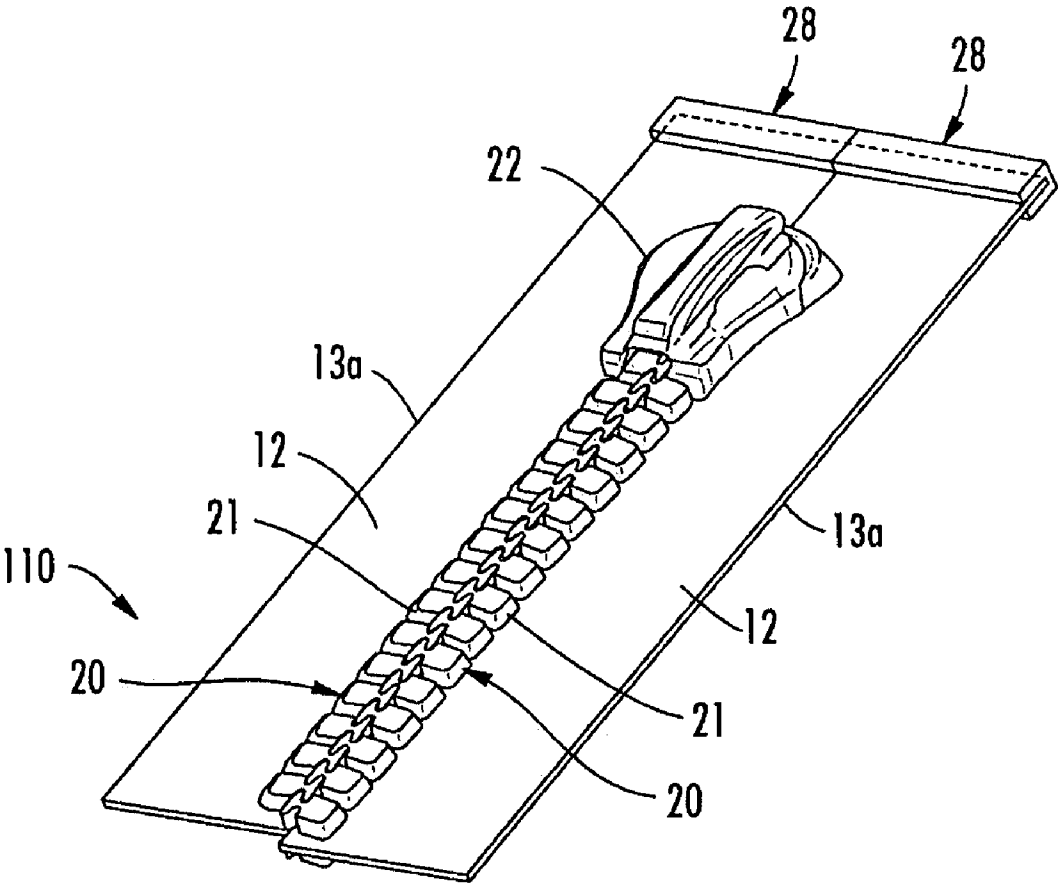
FIG. 7 schematically represents a enlarged perspective view of part of the fastener of FIG. 3, wherein the slider has reached the closing stop of the fastener.

In this manner, as shown in FIGS. 7 and 8, the two tapes 12 are planar when the slider 22 reaches the closing stop 26, i.e. the above folds 32, that are formed on each tape 12 while the slider 22 is moved in its stroke (FIGS. 3 and 6), disappears when the slider 22 reaches the closing stop 26.

This is advantageous as it is possible to precisely, easily and efficaciously join the two tapes 12 of the slide fastener 110 in a fluidtight way to the material of a suit/garment. On the contrary, in the slide fasteners according to the prior art, folds on the tapes are still existing even when the slider reaches its closing stop so rendering the joining of the tapes to the material of a suit/garment difficult to achieve in a reliable way.

In addition, when the slider 22 reached its closing stroke, the free end portions of the inner long edges 13*a* of the tapes 12 (i.e. the portions of the inner long edges above the closing stop 26 along which the tapes are not joined either directly or through the assembly slider 22/teeth 21) are in close contact to each other so preserving the fluidtight requirements of the slide fastener 110 at said free portions of inner long edges 13.

From the previous description it can clearly be seen that the fluidtight slide fastener according to the invention solves the technical problem and achieves numerous advantages the first of which lies in the fact that it shows good fluidtight requirements in the long run as the tapes are obtained fully covered with a fluid-barrier material.

Another advantage lies in that the slide fastener according to the invention can be manufactured in a simple manner and at reduced costs. In this regard, it should be noticed that the operation of heat-cutting the strips forming the tapes or as an alternative the operation of heat-pressing the uncoated edges of the already formed tapes can be easily integrated in all known manufacturing processes of slide fasteners. In addition, such operations are easier to perform than folding uncoated tape edges as in the prior art.

A further advantage of the slide fastener according to the invention lies in that thanks to the peculiar construction of its slider and the closing stop which does not allow formation of folds at the tapes, such tapes are always planar to each other and the free portions of their inner long edges are in close contact when the slider is in its closing stroke. As a result, the slide fastener can be joined to the suit/garment in a easier and reliable manner and the fluidtight requirements of the slide fastener are preserved at the free portions of inner long edges of the tapes.

A further advantage of the slide fastener according the present invention, in comparison with the prior art, lies in that it allows to save a part of the tape necessary to obtain a predetermined length slide fastener.

Of course, a person skilled in the art can bring numerous modifications and variants to the fluidtight slide fastener described above in order to satisfy specific and contingent requirements, all of which are in any case covered by the scope of protection of the present invention, as defined by the following claims.

The invention claimed is:

1. A process for manufacturing a fluidtight slide fastener comprising the steps of providing a plurality of strips of a textile material covered with a fluid-barrier material layer at least on their opposite faces, equipping each coated strip with a plurality of sets of aligned teeth along a longitudinal edge thereof, cutting each coated strip transversally among consecutive sets of aligned teeth to obtain a plurality of tapes of the desired dimensions wherein each tape is equipped with a set of aligned teeth and is uncoated with said fluid-barrier material at at least one of the short edges of each strip, coupling said plurality of tapes in pairs and equipping each pair of tapes with a closing stop, an opening stop and a slider slidable between said closing and opening stops, wherein the process further comprises the step of providing a coating on each tape at said at least one of said uncoated short edges for covering the textile material strip in a fluidtight way at said at least one of said uncoated short edges.

2. The process according to claim 1, wherein the coating step is carried out by heat pressing each tape at said at least one of said uncoated short edges to allow a portion of said fluid-barrier material on the opposite faces thereof to melt and seal at least one of the said short edges thereby covering the textile material in a fluidtight way at said short edge(s).

3. The process according to claim 1, wherein the coating step is carried out by heat pressing each tape at said at least one of said uncoated short edges while filling said uncoated edges with additional fluid-barrier material so as to form a seal covering the textile material in a fluidtight way at said short edges, the seal consisting of said additional fluid-barrier material and a portion of said fluid-barrier material on the opposite faces of the respective tape.

4. The process according to claim 1, wherein the coating step is carried out by applying at least a cap in a fluidtight way on each tape at said at least one of said uncoated short edges.

* * * * *